US005737889A

United States Patent [19]

Habberstad et al.

[11] Patent Number: 5,737,889

[45] Date of Patent: Apr. 14, 1998

[54] DEVICE FOR SEALING OF CONCRETE JOINTS

[75] Inventors: Bent Habberstad, Flateby; Ivar Aanstad, Oslo, both of Norway

[73] Assignee: Ing. B. Habberstad AS, Aurskog, Norway

[21] Appl. No.: 633,828

[22] PCT Filed: Nov. 7, 1994

[86] PCT No.: PCT/NO94/00176

§ 371 Date: Apr. 30, 1996

§ 102(e) Date: Apr. 30, 1996

[87] PCT Pub. No.: WO95/13438

PCT Pub. Date: May 18, 1995

[30] Foreign Application Priority Data

Nov. 10, 1993 [NO] Norway ..... 934070

[51] Int. Cl.[6] ..... B32B 3/14; E04C 2/00

[52] U.S. Cl. ..... 52/396.02; 52/396.05; 52/396.06; 277/75; 277/76; 404/47; 404/49; 404/64

[58] Field of Search ..... 52/396.02, 396.03, 52/396.04, 396.05, 396.08, 396.01; 277/75, 76; 404/47, 49, 64

[56] References Cited

U.S. PATENT DOCUMENTS

| | | | |
|---|---|---|---|
| 3,896,597 | 7/1975 | Deason . | |
| 4,740,404 | 4/1988 | Otsugu et al. | 52/396.03 X |

FOREIGN PATENT DOCUMENTS

| | | | |
|---|---|---|---|
| 0 219 296 A1 | 4/1987 | European Pat. Off. . | |
| 3417294 C2 | 2/1987 | Germany . | |
| 1016106 | 1/1966 | United Kingdom | 52/396.03 |
| 2 205 872 | 12/1988 | United Kingdom . | |

*Primary Examiner*—Wynn E. Wood
*Assistant Examiner*—Timothy B. Kang
*Attorney, Agent, or Firm*—Panitch Schwarze Jacobs & Nadel, P.C.

[57] ABSTRACT

A device for sealing concrete joints is provided. The sealing device includes an elongate section (8) having a larger width than thickness (t). The section (8) has longitudinal edge portions (12, 13) and is intended for casting into two concrete structures (1, 2) for sealing a concrete joint area between the two structures (1,2). A swellable material (7, 14) is provided at least at the longitudinal edge portions (12, 13) thereof. The section (8) is made of a substantially rigid material and is provided with an internal cavity extending over a major part of its width.

10 Claims, 4 Drawing Sheets

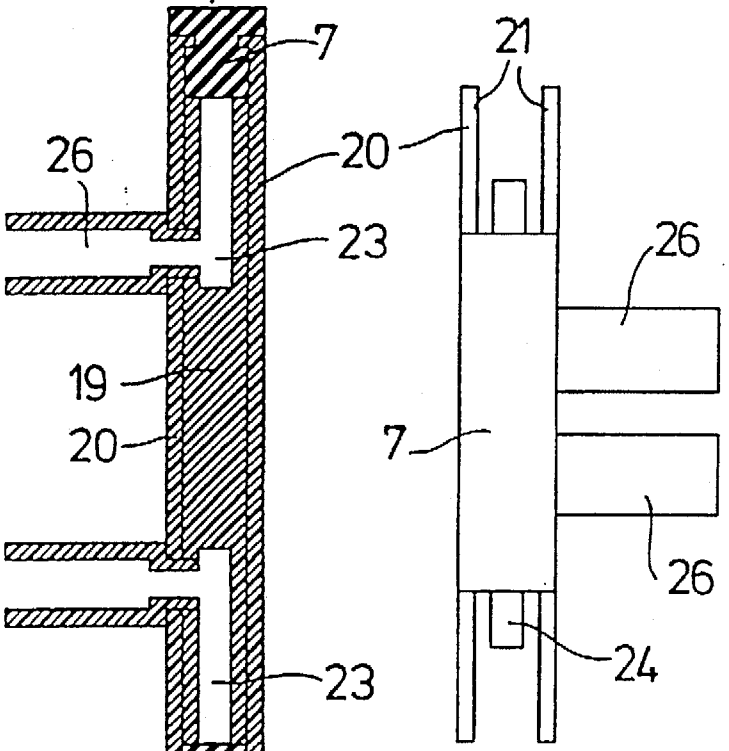
Fig. 6
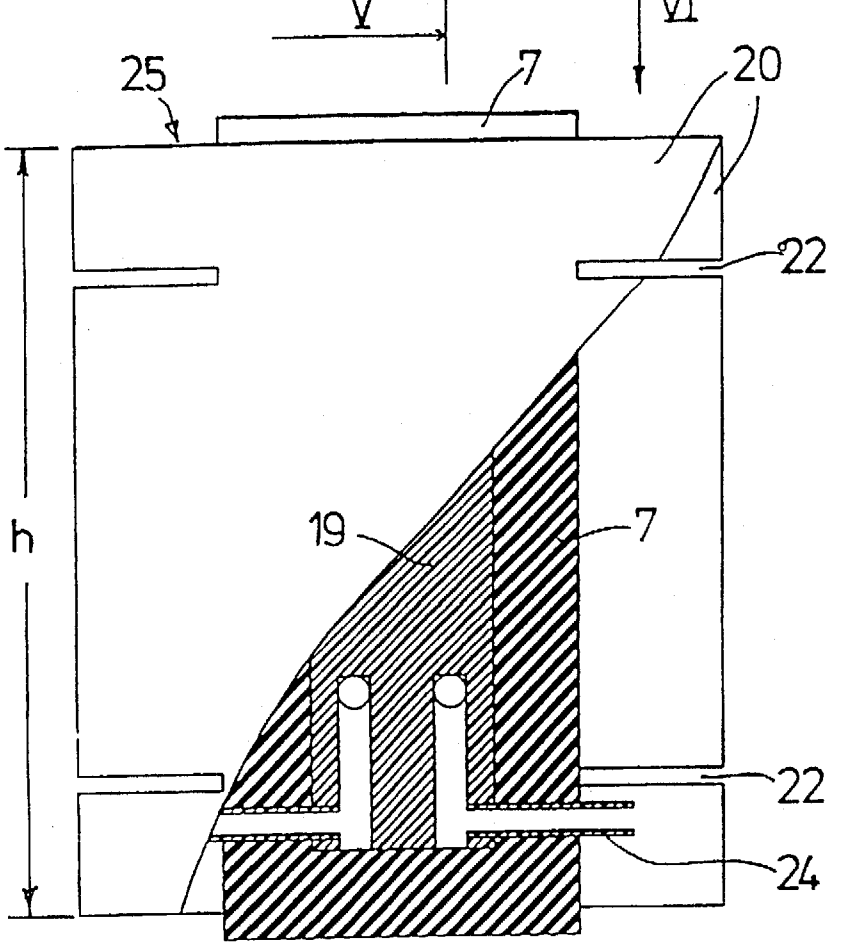
Fig. 5
Fig. 4

DEVICE FOR SEALING OF CONCRETE JOINTS

BACKGROUND OF THE INVENTION

The present invention relates to a device for sealing of concrete joints, comprising an elongate section having larger width than thickness, said section being intended to be cast into two concrete structures in order to seal the joint area between these and is provided with a swelling material at least at their longitudinal edges.

Concrete joints will always be present when a time delay occurs between casting operations. A typical example is the casting of a wall on a previously cast floor.

In practice, it is very difficult to make such concrete joints watertight. This is due to a number of factors, i.a. that the concrete may separate so that its heavier components attach themselves between the form and the steel reinforcement and thereby reduce the concrete quality. This situation may be aggravated because vibration of the concrete may be difficult at the bottom of a wall form. Problems easily occur if the surface against which it is cast, is soiled by sand, gravel, clay or other pollutants, or the surface has a layer of sludge. Furthermore thermal contraction during curing may cause cracks providing passage for the water.

Particularly where some water pressure against the structure is expected, it is therefore common to take special measures in an attempt to seal the joint. Such measures may include placing a swellable material on the cast surface before the next casting operation. One can also place an injection hose in the concrete joint for later injection of a sealing material. Swelling sections are entirely dependent upon contact with good concrete in order to form a pressure against the surroundings. This is difficult to obtain in contact with casting flaws, sand or foreign objects, and if a sludge layer forms during casting, this will prevent good contact with the concrete so that the water may penetrate under or through the sludge layer. In using an injection hose, the problems will generally be the same and in addition, the injected portions will only to a small extent be able to accommodate later movements due to settling, vibrations or thermal effects.

A third method entails using a device of the introductory type as an elongate joint web, usually called waterstop. The elongate joint web, which is known from e.g. EP-A1-0219296 and GB-A-2205872, is made of a plastics material, usually PVC. One half of the joint web is cast into the first concrete structure, the remaining part of the web extending into the area where the next concrete structure is to be cast. There will be no mechanical connection between the joint web and the concrete, but the joint web may be provided with longitudinal ribs in order to extend as much as possible the distance the water has to travel to bypass it. Joining of the joint web must be done by hot welding, often under difficult and cramped conditions, and special joint pieces must be arranged in advance before casting where new concrete joints will occur. These joint pieces have a very complex form, which makes the jointing extra difficult. It is therefore well known that it is difficult to obtain a satisfactory result when sealing by means of joint webs.

SUMMARY OF THE INVENTION

The present invention aims at improving a device of the introductory type so that one avoids, or at least reduces, the drawbacks of the prior art.

This is obtained according to the invention by the section being made of a substantially form stable material and being provided with an internal cavity extending over a substantial part of its width.

The form stability makes the section easy to locate and keep in the correct place during casting, and the location of the swellable material at its longitudinal edges provides for its positioning distant from the joint area and therefore in good quality concrete, where an optimum function of the properties of the swellable material is ensured.

According to an advantageous embodiment of the invention, the longitudinal edge portions of the section are provided with injection holes communicating with injection conduits in the section. Such injection will normally not be necessary but may ensure sealing in special circumstances, such as in extremely poor concrete. In such cases, the injection will be more effective than normal injection because it takes place distant from the concrete joint, where the concrete quality anyway will be better.

Furthermore, it will be advantageous to let each longitudinal edge portion have its own injection conduit. This provides for injecting only one of the edge portions if conditions should so indicate.

In order to prevent the swellable material from coming into contact with water before the installation and embedding of the section, the swellable parts may, according to the invention, be provided with a removable protection cap, e.g. extruded from a plastics material.

In order to give the section the necessary rigidity and form stability without high production costs, it is suggested according to the invention to extrude the section of a plastics or metal material. In order to facilitate jointing of the section to similar sections, it may advantageously have generally parallel sides.

The invention relates also to a jointing element for sealing devices of the type mentioned above. This jointing element is characterized in that it comprises a quadrangular core element having generally the same thickness as said section and which around its periphery is provided with a swellable material, the side faces of the core element being covered by quadrangular plates, one edge dimension of which corresponding substantially to the width of the section while the other edge dimension exceeds the corresponding dimension of the core element including the swellable material.

Such a jointing element can simply be pushed onto an end of two sealing devices to be joined in the longitudinal direction and thus form continuity in the swellable material. The jointing element may also be used where the sealing device is to change direction in the plane of the section, in which case the jointing element is placed on a longitudinal edge of the sealing device and is connected at its other end to a further sealing device. Such an angle joint may be applicable where a wall has to be cast in several sections.

The core element of the jointing element may advantageously be provided with conduits and pipe connecting pieces for connecting to the injection conduits in the section of the sealing device.

Further advantageous features of the invention will become apparent from the following description of the exemplifying embodiments of the invention shown in the appended drawings.

BRIEF DESCRIPTION OF THE SEVERAL VIEWS OF THE DRAWINGS

FIG. 4 is a side view, partly sectioned along the line IV—IV in FIG. 5, of a jointing element according to the invention.

FIG. 5 is a section along the line V—V in FIG. 4.

FIG. 6 shows the jointing element in FIG. 4 seen in the direction of the arrow VI in FIG. 4.

DETAILED DESCRIPTION OF THE INVENTION

Figure 1:
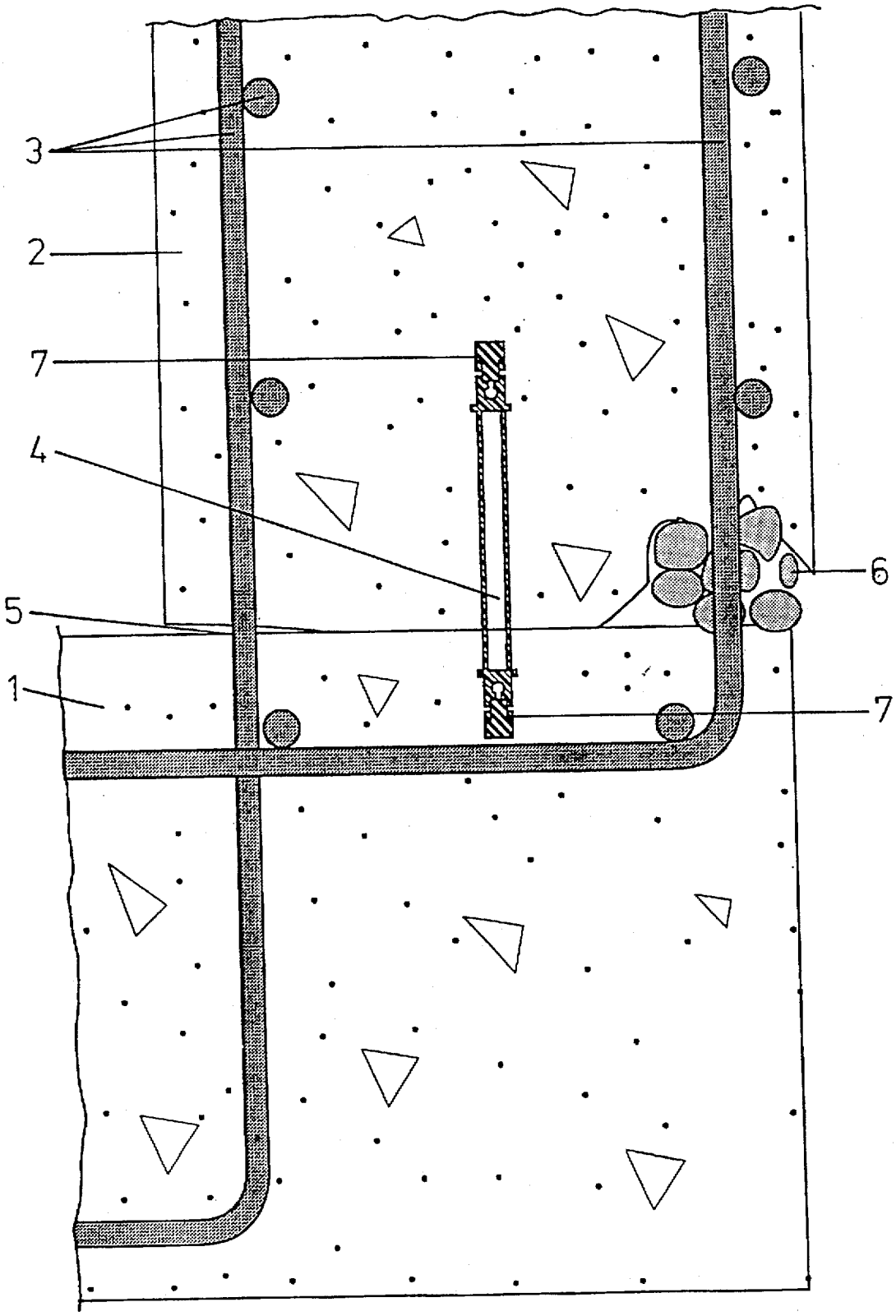
FIG. 1 shows a vertical section through two adjoining concrete structures having a sealing device according to the invention arranged in the joint between the structures.

The concrete structure shown in FIG. 1 is constituted by a floor 1 and a wall 2 erected on the floor with embedded reinforcement 3. A sealing device 4 according to the invention is located in the concrete joint between the floor and the wall. Also, two common casting imperfections are shown in the concrete joint, namely a shrinkage gap 5 and a casting "nest" 6.

It will be understood that the sealing device 4 was cast into the floor 1 in the position shown during casting of the floor, e.g. fixed to the reinforcement rods 3 suitable means. The protruding part of the sealing device 4 was later cast into the wall 2. It will be noted that the longitudinal edges of the sealing device provided with swellable material 7, are located a fair distance from the bad part of the joint area.

Figure 2:
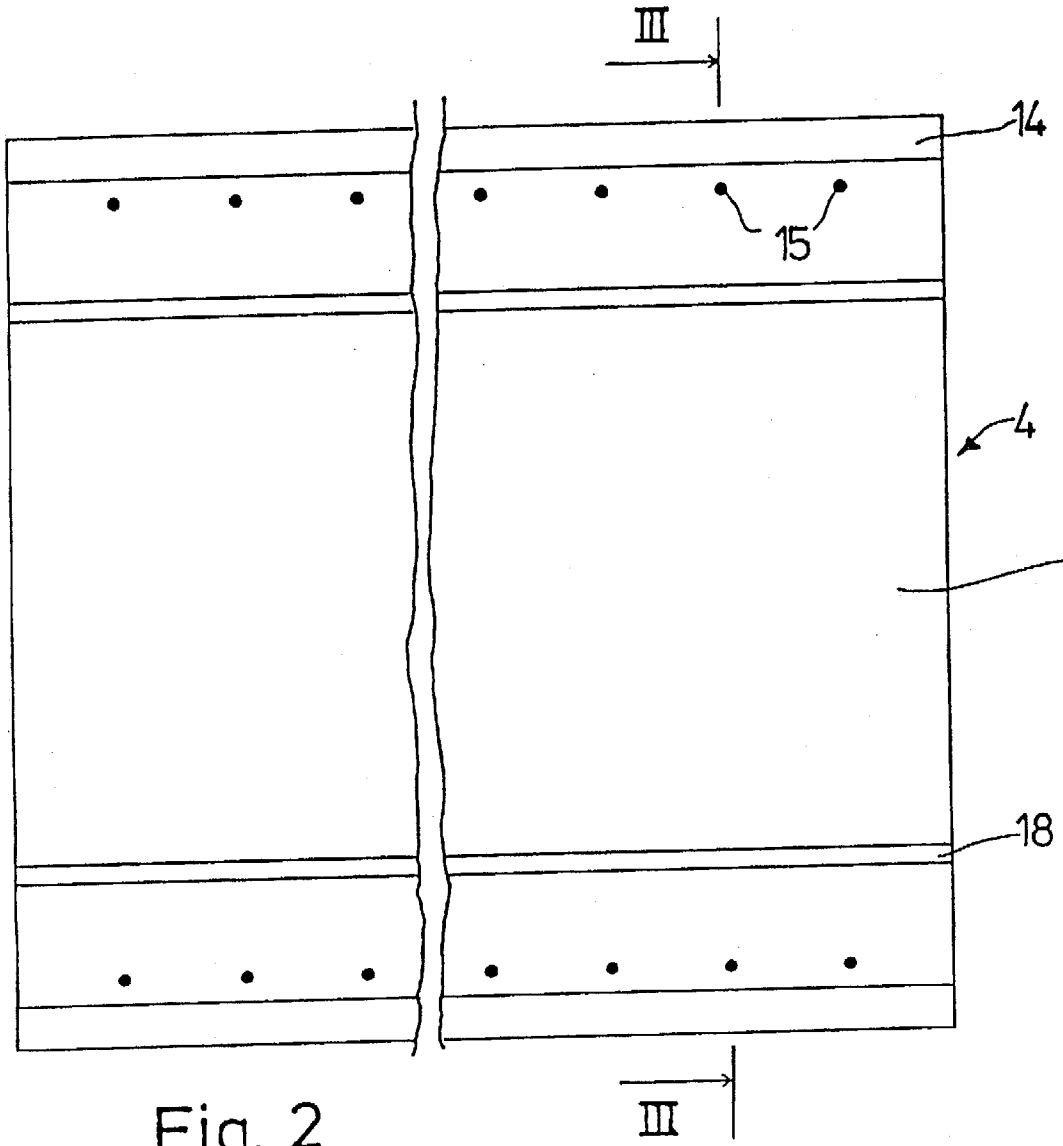
FIG. 2 is a side view of the sealing device according to the invention.

FIG. 2 shows further details of the device according to the invention. It comprises a section 8 having parallel, substantial flat sides 9, 10 and having an internal cavity 11. On its longitudinal edge portions 12, 13 the section 8 is provided with strips 14 of swellable material, e.g. a water swellable rubber. The longitudinal edge portions 12, 13 are further provided with injection holes 15, which communicate with injection conduits 16, 17.

The sides 9, 10 of the section are provided with longitudinal ribs 18, which may serve in attaching the sealing device before or during casting and which further may serve in locating and fixing a joint element, as described in more detail below.

It will be understood that the strips 14 of swellable material may be covered during storage and transportation of the device 4, particularly also the edge strip which is exposed after casting into the first concrete structure 1, in order to prevent the material 7 from coming into contact with moisture before swelling is desired. This protection may for instance be constituted by a U-shaped plastics section pushed in place over the edge strip 14.

Figure 3:
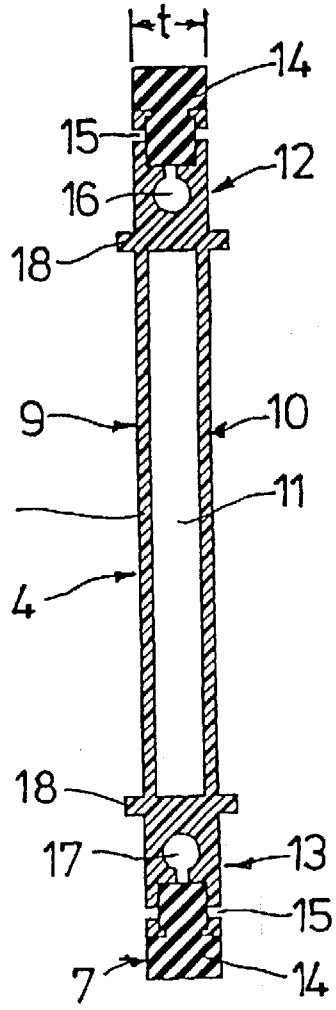
FIG. 3 is a section along the line III—III in FIG. 2.

In FIGS. 4–6 a jointing element is shown for use with the sealing device described above. The jointing element comprises a quadrangular core element 19, e.g. substantially consisting of plastics material, the core element having substantially the same thickness t as the section of the sealing device (see FIG. 3). Around its periphery the core element is provided with swellable material 7, and its side faces are covered by quadrangular plates 20, one edge dimension h of which corresponding to the width of the section 8 of the sealing device. The other edge dimension of the plates 20 exceeds the corresponding dimension of the core element inclusive the swellable material 7 so as to form freely extending portions 21, a space being formed therebetween into which the section 8 of the sealing device 4 may be introduced, said extending portions being provided with slots 22 into which the ribs 18 of the section 8 will fit during the jointing.

Conduits 23 are arranged in the core element 19, from which pipe connecting pieces 24 extend through the swellable material 7. The pipe connecting pieces are located so that they will fit into the injection conduits 16, 17 of the section 8 when the jointing element, here generally designated 25, is mated with the sealing device 4. The conduits 23 in the core element are also connected to pipe connection pieces 26 extending from one of the side plates 20. Through these pipe pieces injection medium may be introduced into the conduits 23 and further into the injection conduits 16, 17 of the sealing device.

Figure 8:
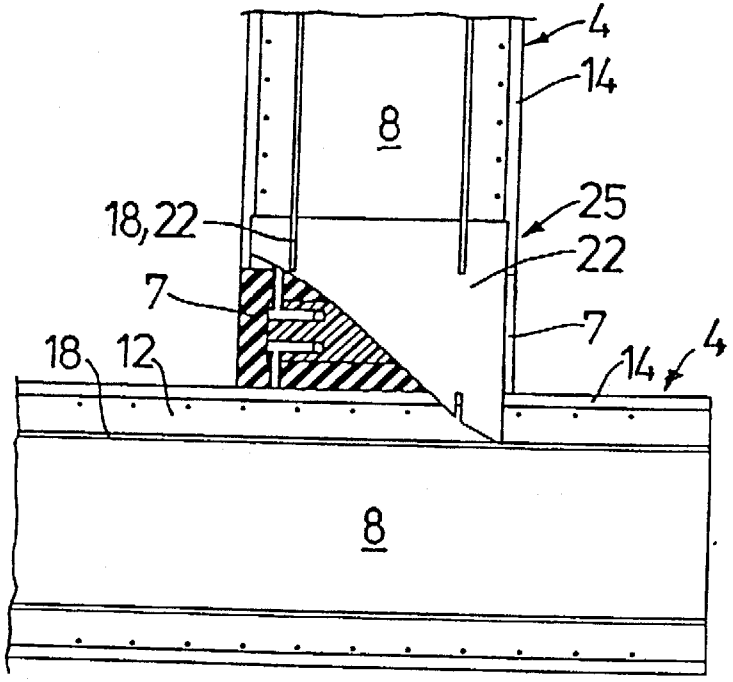
FIGS. 7 and 8 illustrate the assembly of an angular joint between two sealing devices by means of a jointing element according to the invention.
Figure 7:
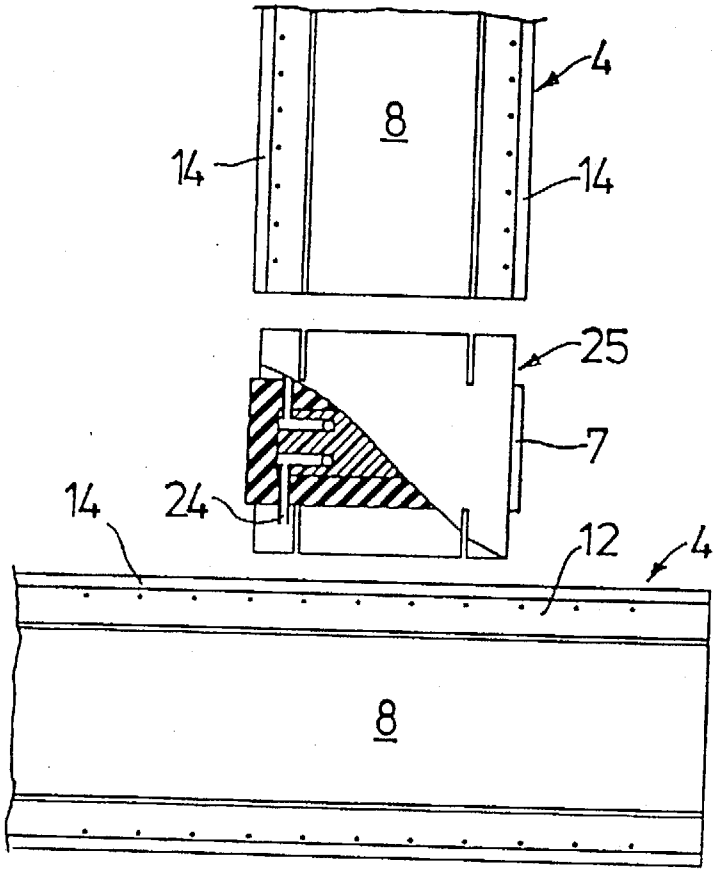

FIGS. 7 and 8 illustrate how a jointing element 25 may be used to form an angular connection between two sealing devices 4.

The jointing element is pushed down on the longitudinal edge portion 12 of the horizontal sealing device 4. The length of the extending portions 21 of the jointing element has been adapted so that these portions come to abut against the longitudinal ribs 18 of the sealing device concurrently with the swellable material 7 of the jointing element coming into contact with the strip 14 of the swellable material on the edge portion 12. In order to provide room for the downwards extending pipe pieces 24 on the jointing element, the strip 14 may be provided with suitable holes, whereby the pipe pieces 24 may serve to fix the jointing element on the sealing device 4 in the longitudinal direction of the latter. Alternatively, the pipe pieces 24 may be removed.

When the jointing element 25 has been placed on the horizontal sealing device 4, the vertical sealing device is pushed down into the slot between the extending plate portions of the jointing device, guidance being provided by the ribs 18 penetrating into the slots 22.

It will be understood that the swellable material 7 of the jointing element 25 forms a continuous transition between the strips 14 of swellable material and the sealing devices 4, so that the tightness of the joint is ensured.

It will be understood that according to the present invention, one has provided a very favourable device for sealing concrete joints, said device being simple and reliable in use and providing substantial flexibility both with respect to jointing and branching. Since the section of the device is relatively rigid, it may be transported and handled without danger of permanent deformations, and the rigidity will also reduce bending due to casting loads to a minimum. The hollow form of the section provides the device with ability to withstand limited shear movements, and even if one of the sides 9, 10 of the section should be damaged, the other side will be able to maintain the necessary sealing.

We claim:

1. A device for sealing concrete joints, comprising an elongate section (8) having a larger width than thickness (t), said section (8) having longitudinal edge portions (12, 13) and being intended for casting into two concrete structures (1, 2) for sealing a concrete joint area between the two structures (1,2), and being provided with a swellable material (7, 14) at least at the longitudinal edge portions (12, 13) thereof, characterized in that the section (8) is made of a substantially rigid material and is provided with an internal cavity extending over a major part of its width.

2. A device according to claim 1, characterized in that the longitudinal edge portions (12, 13) of the section (8) are provided with injection holes (15) which communicate with injection conduits (16, 17) in the section.

3. A device according to claim 2, characterized in that each longitudinal edge portion (12, 13) has a separate injection conduit (16, 17).

4. A device according to claim 1, characterized in that the swellable material (14) is provided with a removable protecting cap.

5. A device according to claim 1, characterized in that the section (8) is extruded from a rigid plastics or metal material.

6. A device according to claim 1, characterized in that the internal cavity of the section (8) has a substantially rectangular cross-section.

7. A device according to claim 6, characterized in that the sides (9, 10) of the section are provided with longitudinal ribs (18).

8. A jointing element for sealing devices (4) according to claim 1, characterized in that said jointing element comprises a quadrangular core element (19) which has substantially the same thickness (t) as said section (8) and swellable material (7) is provided around the periphery thereof, the side faces of the core element (19) being covered by quadrangular plates (20), one edge dimension (h) of said quadrangular plates substantially corresponding to the width of the section (8), the other edge dimension exceeding the corresponding dimension of the core element (19) including the swellable material (7).

9. A jointing element according to claim 8, characterized in that the core element (19) is provided with conduits (23) and pipe connecting pieces (24, 26) for connecting to the injection conduits (16, 17) of the section.

10. A jointing element according to claim 8, characterized in that the side plates (20) are provided with slots (22) for cooperation with the ribs (18) of the section.

* * * * *